United States Patent [19]

Raber

[11] 4,227,191

[45] Oct. 7, 1980

[54] LIGHT EMITTING SMOKE DETECTOR

[76] Inventor: Samuel Raber, c/o Pyrotronics, 8 Ridgedale Ave., Cedar Knolls, N.J.

[21] Appl. No.: 879,205

[22] Filed: Feb. 21, 1978

[51] Int. Cl.[2] ..... G08B 17/10; F21V 33/00

[52] U.S. Cl. ..... 340/628; 340/326; 340/636; 362/253

[58] Field of Search ..... 340/628, 629, 630, 517, 340/371, 326, 329; 362/253

[56] References Cited

U.S. PATENT DOCUMENTS

| | | | |
|---|---|---|---|
| 2,278,920 | 4/1942 | Evans et al. | 340/630 |
| 3,304,545 | 2/1967 | Bell et al. | 340/629 |
| 3,634,846 | 1/1972 | Fogiel | 340/629 |
| 3,810,170 | 5/1974 | Zinsmeister | 340/371 |
| 3,922,655 | 11/1975 | Lecuyer | 340/630 |
| 4,037,206 | 7/1977 | Dobrzanski et al. | 340/629 |
| 4,074,225 | 2/1978 | Vandeweghe | 340/329 |

*Primary Examiner*—John W. Caldwell, Sr.

[57] ABSTRACT

A smoke detector is provided having a smoke detection circuit coupled with an audible alarm and a high intensity light source. The high intensity light source is powered separately from the smoke detection and audible alarm system.

5 Claims, 4 Drawing Figures

LIGHT EMITTING SMOKE DETECTOR

BACKGROUND OF THE INVENTION

1. Field of the Invention

The present invention relates to smoke detection devices, and more particularly, to a smoke detection device associated with an alarm system and a lighting system.

2. Prior Art

Smoke detectors for residential use have become increasingly popular in recent years, which has resulted in many different types and variations being available on the market. There are two basic types which enjoy the most popularity, these being the ionization and photo-electric cell types. The ionization type of detector basically utilizes a radioactive source to ionize the air inside a chamber, having a voltage applied across it. The ionized air produces a small electric current, and when smoke particles enter the detector, they impede the flow of current, which results in a current reduction that in turn sets off an alarm.

The photo-electric type of detector has a lamp which directs a light beam into a chamber. The chamber contains a light sensitive photo-cell which is normally not positioned directly in the light source's beam, but when smoke enters the chamber, the smoke particles scatter the light beam, resulting in light impinging on the photo-cell. This in turn sets off the alarm.

Each type has its advantages and disadvantages with regard to detecting particular types of fires or smokes, and each also has other advantages and disadvantages. For example, the ionization detectors can generally be battery operated, while the photo-cell type usually requires connection to a conventional AC power outlet to power the light source. In the case of the use of batteries, they eventually wear out and must be replaced, while in the use of a conventional AC outlet power source, if there is a power failure, the smoke detector becomes inoperative.

In any event, the smoke detectors of the prior art are almost always associated with an audible alarm which awakens or alerts the occupants of the residence so that they may escape injury. Some smoke detectors have been designed with lights which are used to indicate which of a plurality of smoke detecting units is being activated so as to indicate more closely the source of danger. Still other smoke detectors have been designed with flashing lights, which are particularly advantageous for use by the deaf.

One problem which has not been faced by any of the prior art types of smoke detectors referred to above is the fact that once the density of the smoke becomes substantial, visibility in the area of the smoke is greatly impaired. This can result in the occupants not being able to flee the danger since they are not able to see their way to the direction of an exit.

A further problem associated with the prior art devices, particularly those utilizing a flashing light source, is that the light source is generally powered by a conventional AC outlet which usually fails shortly after a major fire develops. This renders the light source useless about the time that it is most needed.

SUMMARY OF THE INVENTION

The present invention overcomes the above described disadvantages and difficulties associated with the prior art devices by providing a high intensity light source associated with a smoke detection and audible alarm device which are separately powered but interconnected sufficiently so that the light source is activated by operation of the smoke detection device.

The smoke detection device basically comprises a means for detecting the presence of a predetermined level of smoke density and providing an electrical output signal when the predetermined level is reached, an alarm means for receiving the signal from the smoke detection means and for providing a continuous or continuously periodic audible signal as long as the smoke density remains above the predetermined level, and a light circuit for receiving the signal from the smoke detection device and for providing a high intensity continuous light as long as the smoke density remains above the predetermined density level.

Several variations of connections and power sources are contemplated with the present invention, depending upon the particular use of the device. It is preferable that the power source to the smoke detection device and alarm be separate from the power source to the light source in order that the failure of the later does not cause the failure of the former. It is also preferable, although not essential, that the power supply for the light source be battery operated. In the case of a preferred embodiment, both power sources are batteries.

Separation of power sources is advantageous since if there should be a failure of any component of the light circuit, it will not affect operation of the smoke detector and audible signal. Not having the light source dependent upon the AC circuitry of the residence, but being battery powered instead, prevents the light source from being interrupted due to fire causing a shorting out or opening of the circuitry in the residence. It is contemplated that the separate high intensity light source can be utilized with either the ionization or photo-cell types of smoke detection devices.

Since, in the preferred form, the light source and smoke detection device are operated by separate batteries, it is preferable to provide battery testing circuits for each of these batteries in order to determine when the power of the batteries has become sufficiently low that they need to be replaced. The battery test circuitry can be composed of a single circuit connected to both batteries or two separate circuits, one connected to each battery. In either case the audible signal device or horn is connected to the circuitry for testing both batteries so that the audible signal is given when the batteries become too low to provide normal operation of both the smoke detection device and the light source.

DETAILED DESCRIPTION OF THE PREFERRED EMBODIMENT

Figure 1:
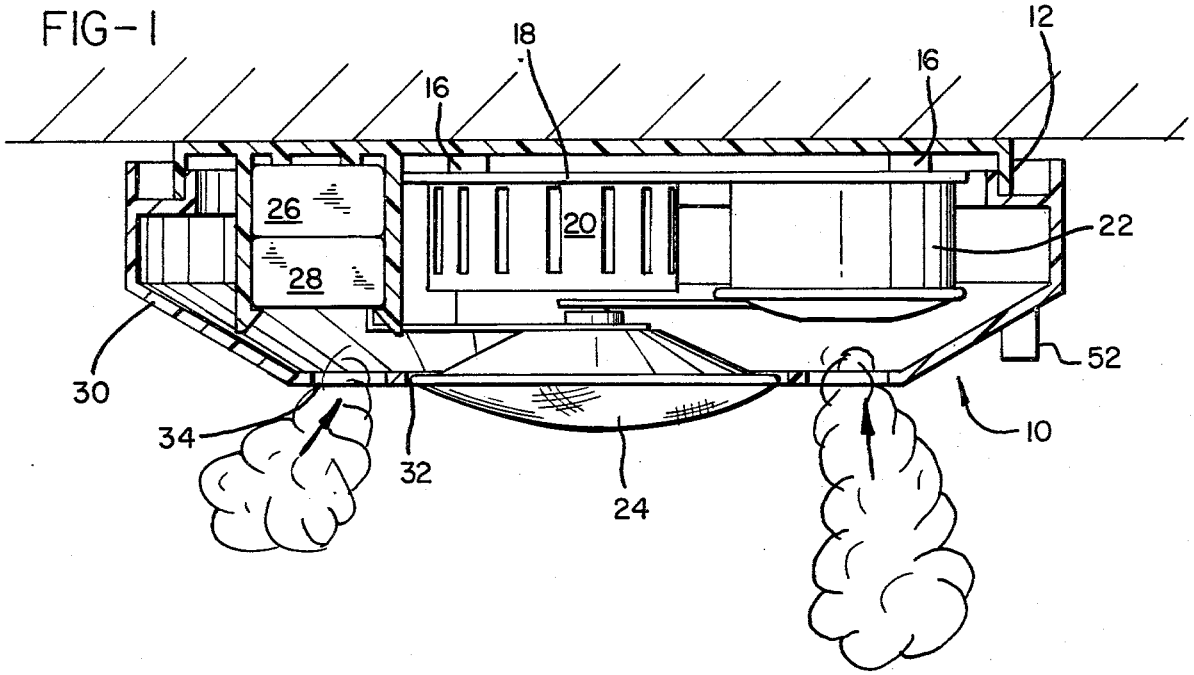
FIG. 1 is a vertical cross sectional view through the preferred embodiment of the smoke detector of the present invention secured to a ceiling.

Referring to FIG. 1, there is shown therein a generally cylindrical smoke detection device 10 constructed in accordance with the present invention. It is provided with a cylindrical base member 12 which can be provided with holes (not shown) where bolts may be inserted, or it can be provided with other means by which the smoke detection device 10 can be secured to a ceiling 14 or a wall, whichever is desired.

Supported within the cylindrical base member 12 by support members 16 is a printed circuit board 18 containing the circuitry for operating the smoke detection device 10. The printed circuit board 18 is preferably made sufficiently strong to support also the other major components of the smoke detection device 10. They include a smoke sensing device 20, the audible alarm 22, the high intensity light 24, and batteries 26 and 28. The printed circuit board can be used to interconnect these various components in the manner illustrated in the circuit diagram of FIG. 4, as described below.

In the preferred embodiment, the smoke sensing device 20 is preferably an ionization type which can be battery operated. The audible alarm 22 can, for example, be a horn of the type typically used in such smoke detection devices, which is sufficiently audible to be heard by persons in the vicinity of the smoke detector when it is operating. The high intensity light source 24 can utilize any one of a variety of high intensity DC light bulbs such as those commonly used in high powered hand held flash lights. The construction of the light source 24 should be such that the beam of light will be directed in a conical pattern outwards so that when the smoke detection device is secured to the ceiling it will illuminate the area immediately beneath the detector so as to provide visibility at a level of smoke density which would otherwise be sufficient to impair the vision of persons, particularly in the night time.

The batteries 26 and 28 can be of whatever voltage is necessary to operate the light source circuit and the smoke detector and alarm circuits independently for a sufficient period of time to alert persons of the danger and provide light for a long enough period that they may evacuate from the danger area. Overly covering and surrounding the printed circuit board 18 and base member 12 is a frusto-conically shaped cover member 30. It is provided with a central circular opening 32 through which the light source 24 extends and is also provided with a plurality of radially extending slots 34 extending around the surface area in any desired pattern so long as there are a sufficient number to permit the smoke to enter in the area of the smoke sensor 20.

Figure 4:
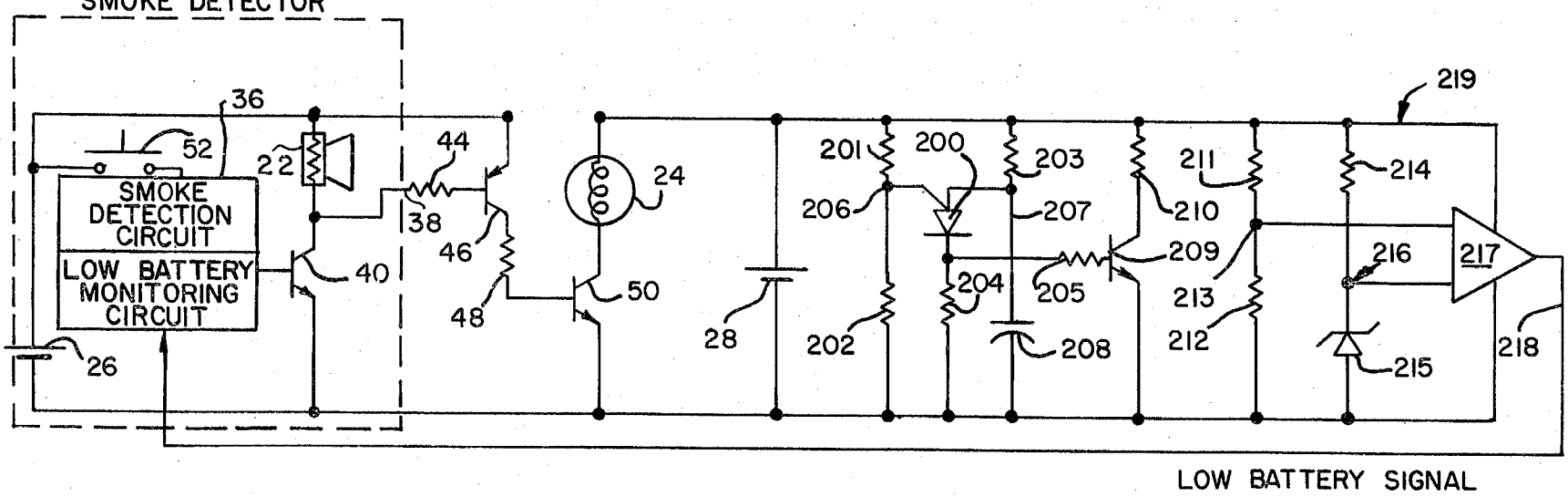
FIG. 4 is a schematic circuit diagram of circuitry capable of operating the preferred embodiment in the desired manner.

Referring now to the schematic circuit diagram illustrated in FIG. 4, the basic smoke detector circuit 36 is of conventional design such, for example, as disclosed in U.S. Pat. No. 4,004,288 which includes a horn such as 22 illustrated in FIG. 1. Since there are a variety of such circuits available in the prior art, a particular circuit will not be described in detail herein. Reference should therefore be made to prior art for such circuitry. It is believed, however, that novelty lies in the manner of associating such conventional smoke detector circuitry with the high intensity light source of the present invention.

In this regard, it is to be noted in FIG. 4 that two batteries, i.e. voltage sources 26 and 28, are used since this is the preferred embodiment as mentioned above. Voltage source 26 is intended to operate the smoke detector circuit 36 and the associated audible alarm 22, while voltage source 28 is intended to operate the high intensity light 24. To accomplish this task, the smoke detector circuit output 38 is connected to a transistor 46 which, upon emission of a signal from the smoke detector circuit 36, causes current flow through audible alarm 22 and resistor 44, which in turn activates transistor 46 to cause current flow through resistor 48. This in turn causes current flow through transistor 50 which is supplied from the battery 28, and thus light 24 is lit.

Resistor 44 is made of sufficiently high resistance, such as 10 K ohms, in comparison to the resistance of audible alarm 22 and resistor 48 which are, for example, 560 ohms, that resistor 44 effectively isolates the smoke detector and alarm circuit from the light circuit. This is important, since if for some reason resistor 44 or the light circuit were to fail, i.e. causing an open or short circuit, the smoke detector circuit 36, including the audible signal, will continue to operate.

A test switch 52 is provided in order to test the functioning of the smoke detector circuit 36 in a conventional manner. In the present device, however, when the switch is activated, the smoke detector circuit activates the transistor 40 and therefore the light 24 is also tested through the circuitry as described above with actual functioning of the smoke detector.

With regard to the battery test circuitry utilized for determining whether or not the batteries, i.e. voltage sources 26 and 28, have sufficient power to properly operate the high intensity light 24 and the audible signal device 22, a preferred form of the test circuitry is illustrated in FIG. 4. This part of the circuit is basically composed of two separate parts: (1) one minute relaxation oscillator, and (2) a low battery circuit. It is to be noted that the description given below and the associated circuitry illustrated in FIG. 4 are shown for monitoring only the voltage source 28. It is contemplated that the same circuitry will be used for monitoring the voltage source 26 and it will be secured thereto in the same manner as the circuitry shown is secured to voltage source 28.

The oscillator makes use of a Programmable Unijunction Transistor (PUT) 200, 5 resistors 201–205 and one capacitor 208. The two resistors 201,202, connected to the gate of the PUT, set up a bias voltage 206. The PUT will fire only when the anode voltage 207 is higher than the gate voltage by the offset voltage (0.2 to 0.6 V). When this occurs, the anode will short to cathode discharging the capacitor 208 and creating a voltage pulse through the cathode resistor 204.

The low battery circuit is designed to test the battery under simulated load. Testing in this fashion gives the best possible indication of condition of the battery. To accomplish this, the testing and loading of the battery is performed during a short pulse time. This pulse is repeated once every minute. To obtain the pulse, the output voltage pulse of the one minute oscillator is applied to the base of a transistor 209 through a resistor 205. When 209 is energized, its collector is saturated and the simulated battery loading resistor 210 is connected across the battery.

Resistors 211 and 212 form a voltage divider at 213, which is applied as an input to voltage comparator 217. The other comparator input is a stable reference voltage provided by zener diode 215. Resistor 214 provides zener diode bias current.

When the battery condition is tested under simulated load by resistor 210, the battery voltage will fall at 219 as will the comparator input at 213. If the voltage at 213 falls below the reference voltage at 216, the comparator output 218 will trigger the smoke detector circuit 36 to beep the horn, thereby indicating that the battery requires replacing.

Figure 2:
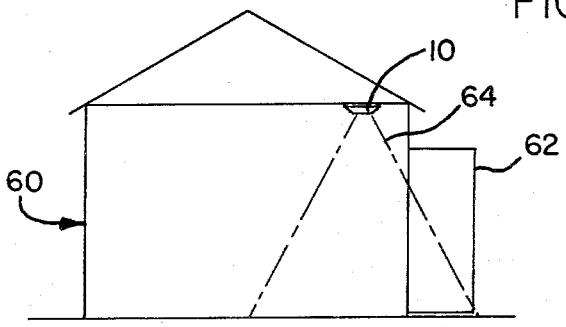
FIG. 2 is a schematic side elevational view of a house with a desired positioning of the preferred embodiment of the present invention.
Figure 3:
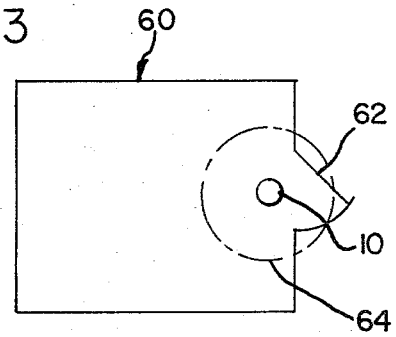
FIG. 3 is a schematic top plan view of the house of FIG. 3.

Although the smoke detector made in accordance with the present invention can be positioned at almost any desired location on the upper portion of a wall or on the ceiling where it will provide illumination to assist in egress from a building, there are preferred locations for at least one such smoke detector especially where multiple units are utilized. This is best shown in connection with FIGS. 2 and 3 which schematically illustrates a house 60 with a door 62 opening to the outside providing a means of escape. The smoke detection device 10 is preferably positioned sufficiently close to the door 62 that the generally conical light pattern 64 will illuminate the doorway in the night time so as to show to the occupants of the dwelling the means of escape.

Further, although the foregoing embodiment is preferred, there are many variations which are possible and are contemplated to be within the scope of the present invention. For example, as previously mentioned, it is believed that the same principle can be utilized with photo-cell type smoke detection devices. Such a device, for example, could include the circuitry as disclosed in U.S. Pat. No. 4,001,800, which would be connected in the same manner with a light source 24 using generally the same circuitry illustrated in FIG. 4, although obviously, changes in components would be required due to the use of 60 cycle current instead of a battery power supply for the photo-cell type of detector. It is further contemplated that if such a photo-cell system were utilized, a battery could still be utilized to operate the light source 24 in identically the same manner as described in connection with the preferred embodiment. It is therefore believed that the present invention should be limited only by the scope of the following claims, and that the preferred embodiment described above is merely by way of illustration only.

What is claimed is:

1. A protection system including a smoke detector section and an escape light section, in which the smoke detector section includes means for detecting the presence of a predetermined level of smoke density and providing an electrical output signal when said level is reached, and means for receiving said signal and providing an audible alarm only as long as said smoke density remains above said predetermined level, the system improvement in which the escape light section comprises additional means for receiving said signal and providing a high-intensity, continuous light of a level sufficient to illuminate the adjacent floor area only as long as the smoke density remains above said predetermined level, and in which said system includes first and second power supply means, said first power supply means independently operating said smoke detector section, and said second power supply means independently operating said escape light section.

2. A protection system as defined in claim 1 in which said additional means for receiving said signal includes means providing substantial isolation between the smoke detector section and the escape light section, such that a component failure in the escape light section will not affect operation of the smoke detector section.

3. A protection system as defined in claim 1 wherein said first and second power supply means are batteries.

4. A protection system as defined in claim 3, and further comprising a test circuit connected to said second battery and to the means for receiving said signal in the smoke detector section to provide a different audible alarm if said second battery is at a level sufficiently low that it will no longer activate the section of the system in which it is connected.

5. A protection system as claimed in claim 4, in which said test circuit includes means for periodically testing said second battery under simulated load conditions.

* * * * *